US010556324B1

(12) United States Patent
Torres

(10) Patent No.: US 10,556,324 B1
(45) Date of Patent: Feb. 11, 2020

(54) TRIMMER BLADE MODIFIER

(71) Applicant: Chuka A. Torres, Sacramento, CA (US)

(72) Inventor: Chuka A. Torres, Sacramento, CA (US)

( * ) Notice: Subject to any disclaimer, the term of this patent is extended or adjusted under 35 U.S.C. 154(b) by 43 days.

(21) Appl. No.: 15/810,403

(22) Filed: Nov. 13, 2017

Related U.S. Application Data

(60) Provisional application No. 62/421,075, filed on Nov. 11, 2016.

(51) Int. Cl.
*B24B 3/36* (2006.01)
*B24D 15/06* (2006.01)
*B26B 19/38* (2006.01)

(52) U.S. Cl.
CPC ..... *B24D 15/06* (2013.01); *B26B 19/3846* (2013.01)

(58) Field of Classification Search
CPC .. B24B 3/36; B24B 3/60; B24D 15/06; B26B 19/3846
USPC ..... 451/45, 552, 555, 556; 76/82, 86, 88, 76/82.2
See application file for complete search history.

(56) References Cited

U.S. PATENT DOCUMENTS 458,004 A * 8/1891 Smith ..... B24D 15/063 76/82.2
736,245 A * 8/1903 Goodfellow ..... B24D 15/08 451/555
2,645,066 A * 7/1953 Andrews ..... B24D 15/065 451/555
3,797,334 A * 3/1974 Sinclair ..... B23D 67/10 451/555
8,152,600 B2 * 4/2012 Bagley ..... B24D 15/06 451/45

* cited by examiner

*Primary Examiner* — Robert A Rose
(74) *Attorney, Agent, or Firm* — Heisler & Associates

(57) ABSTRACT

A base includes a top surface with an elongate slit formed therein. A grinder, such as in the form of a grinding stone, is located within the base and beneath the slit. The stone is in a slot in an undersurface opposite the top surface. The slot is angled to present a grinding surface of the grinding stone at an appropriate angle for forming a face surface in a trimmer blade at a desired angle. The slit has a flat side and an angled side to assist in having a trimmer blade held vertically and at a proper angle for forming of the face. The base includes a finger purchase area to hold the base adjacent to an underlying surface for stability while moving a trimmer blade within the slit adjacent to the grinding surface to form the face at the desired face angle adjacent to the trimmer blade tip.

17 Claims, 4 Drawing Sheets

TRIMMER BLADE MODIFIER

CROSS-REFERENCE TO RELATED APPLICATIONS

This application claims benefit under Title 35, United States Code § 119(e) of U.S. Provisional Application No. 62/421,075 filed on Nov. 11, 2016.

FIELD OF THE INVENTION

The following invention relates to tools which can modify teeth of a cutting tool such as a trimmer blade and particularly an electric trimmer blade which includes a moving trimmer blade which moves laterally relative to a stationary trimmer blade, such as for cutting hair. More particularly, this invention relates to blade modifiers which are configured to grind a face adjacent to a tip of the trimmer blade with the face having a greater angle than a facet of the trimmer blade and with the face closer to the tip of the trimmer blade then the facet of the trimmer blade.

BACKGROUND OF THE INVENTION

Trimmers are known in the prior art for cutting hair and other items. Such trimmers are often powered, such as by an electric motor, and configured to be a handheld tool to be wielded in a variety of different angles and positions for effective cutting, especially of hair. The trimmer generally includes two parts which move relative to each other including a stationary trimmer blade and a movable trimmer blade. The motor is appropriately interposed between the stationary trimmer blade and the movable trimmer blade (generally through intervening structures) to cause the movable trimmer blade to move back-and-forth laterally directly adjacent to the stationary trimmer blade. Teeth at a tip of the movable trimmer blade and the stationary trimmer blade have sharp lateral edges which cut individual hairs (or other structures) and allow for even cutting, especially of short hair.

One problem with such trimmers is that there is generally a limit to the shortness with which hair can be cut, because the tip of the movable trimmer blade is somewhat blunt where a facet at a distal portion of the trimmer blade intersects with a reference surface of the trimmer blade. Accordingly, a need exists for methods and tools for modifying a trimmer blade, and particularly a moving trimmer blade of a trimmer to make this tip less blunt and configured to allow hair to be cut shorter than would otherwise be the case.

Grinding stones are known which are hard enough to grind away tool steels. However, it can be difficult to get the correct angle when grinding, especially for those with less experience. Accordingly, a need exists for a tool which an hold the grinder at a proper angle relative to the trimmer blade to properly modify the trimmer blade and allow for cutting of shorter hair.

SUMMARY OF THE INVENTION

With this invention, the teeth at the distal end of the trimmer blade which already taper down at a facet thereof extending from a heel of the blade toward a tip of the blade, are modified to include a face extending between a transition adjacent to the facet and down to the tip at the most distal portion of the trimmer blade. To provide such a modified trimmer blade, a tool is provided for grinding and forming this face surface at the distal tip, especially for the movable trimmer blade.

The tool according to this invention includes a base which holds a grinding stone (or other grinder) with a grinding surface at a desired angle for forming the face. The base is preferably configured with an under surface which can be held adjacent to a horizontal underlying surface when the tool is used. The top surface opposite this under surface includes a slit therein through which the grinder, such as the grinding stone, can be accessed by the trimmer blade. The slit is elongate in form, and the base is also elongate in form. Preferably the base has ends which are further apart than a length of the slit between ends thereof, so that finger purchase areas are provided between ends of the slit and ends of the base. The trimmer blade is oriented vertically within this slit, extending down to the grinding surface. The trimmer blade is then slid in a back-and-forth manner within the elongate slit, grinding away portions of the facet to form the face adjacent to the tip.

To assist in orienting the trimmer blade as desired, and generally within a vertical plane, the slit preferably includes opposing sides including a flat side and an angled side. The flat side is provided on the side of the slit which is opposite the grinding surface of the grinding stone. The angled side of the slit has an angle which can vary between generally matching an angle of the facet relative to a reference surface of the trimmer blade and matching an angle of the face adjacent to the distal tip relative to this reference surface. A lowermost portion of the slit is sufficiently wide so that distal portions of the trimmer blade can fit down entirely through the slit and come into contact with the grinding surface of the grinding stone, but preferably with a flat stopper formed in the bottom of the slit to keep the trimmer blade from being over sharpened.

The grinding stone is preferably fitted within the base by passing up through a slot formed in an undersurface of the base. This slot is sized and shaped to hold the grinding stone therein and to present the grinding surface of the grinding stone at a desired angle to be imparted upon the trimmer blade to form the face at a desired angle relative to the reference surface of the trimmer blade. The grinding stone is preferably square in cross-section (or rectangular) and the slot preferably has a corresponding geometry so that the grinding surface is presented at the desired angle for forming of the face. This angle for the face is preferably greater than an angle of the facet relative to the reference surface. To achieve this angle for the face, the grinding surface is held in the slot at an angle matching the desired angle for the face surface.

Once the trimmer blade has been modified to include the face, a sharper tip is provided and the movable trimmer blade can be positioned appropriately relative to the stationary trimmer blade to achieve the desired very short trimming of hair (and other similar items).

OBJECTS OF THE INVENTION

Accordingly, a primary object of the present invention is to provide a tool for modifying a trimmer blade to cause a face and sharp tip to be provided at a distal portion of the trimmer blade adjacent to teeth thereof.

Another object of the present invention is to provide a face at a distal tip of a facet of a trimmer blade which has an angle greater than an angle of the facet, relative to a opposing reference surface, and with the face adjacent to a tip of the trimmer blade.

Another object of the present invention is to provide a tool for modifying a trimmer blade so that the trimmer can cut hair shorter than what otherwise would be the case.

Another object of the present invention is to provide a modified trimmer blade with a sharper tip than an unmodified similar trimmer blade.

Another object of the present invention is to provide a method for modifying a trimmer blade to add a face at a distal end of a facet of the trimmer blade to provide a sharper tip at a distal end of the trimmer blade adjacent to teeth thereof.

Another object of the present invention is to provide a hair trimmer which can cut hair exceptionally short, and to enhance usefulness of a hair trimmer.

Other further objects of the present invention will become apparent from a careful reading of the included drawing figures, the claims and detailed description of the invention.

DESCRIPTION OF THE PREFERRED EMBODIMENT

Figure 1:
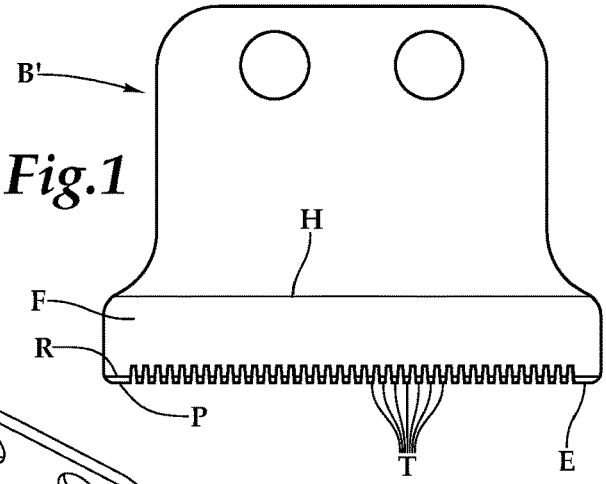
FIG. 1 is a front elevation view of a trimmer blade which has been modified according to a method of this invention and utilizing a tool of this invention.
Figure 2:
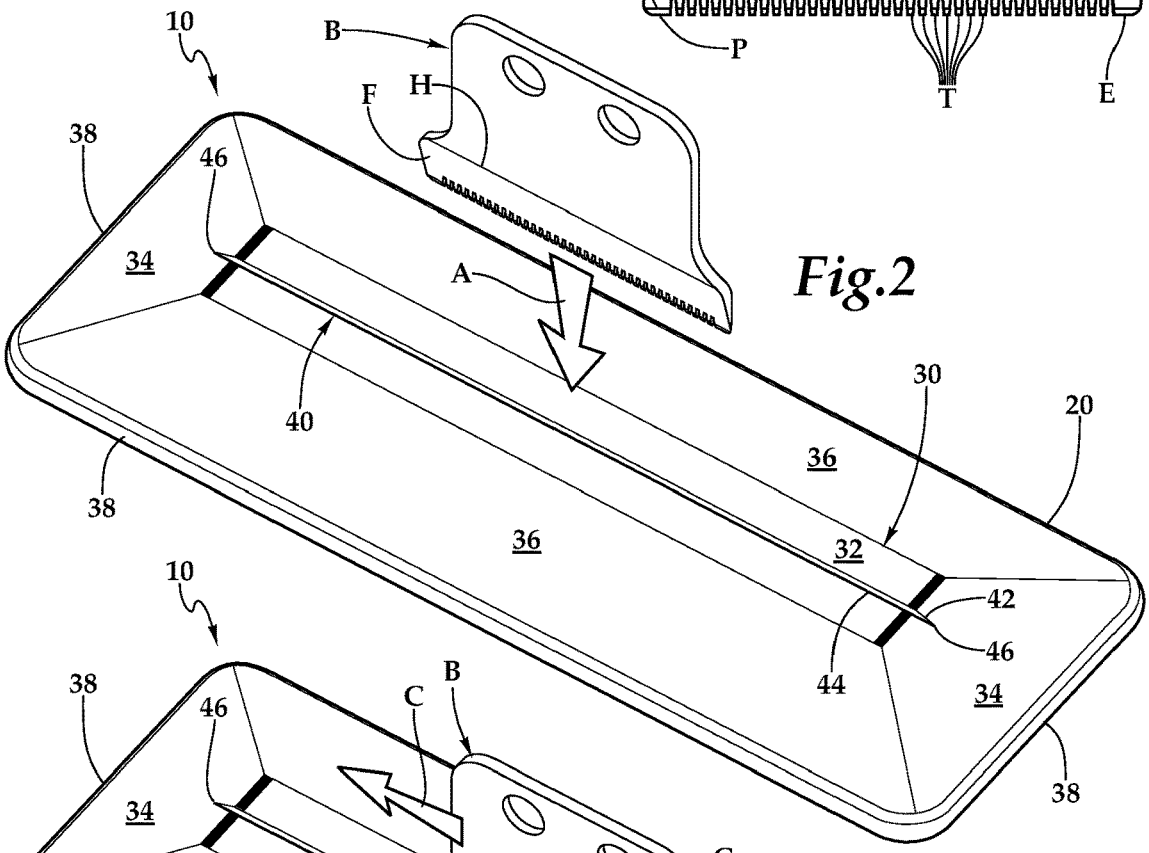
FIG. 2 is a perspective view of a trimmer blade being inserted into a trimmer blade modifier tool for modification of the trimmer blade.

Referring to the drawings, wherein like reference numerals represent like parts throughout the various drawing figures, reference numeral 10 is directed to a modifier for a trimmer blade B. The modifier 10 includes a grinder such as in the form of a grinding stone 60 held within a base 20 to facilitate forming of a face E adjacent to a tip P of the blade B and closer to the tip P then a facet F adjacent to the face E. The modifier 10 forms the face E at a face angle β which is greater than a facet angle α of the facet on the blade B.

In essence, and with particular reference to FIGS. 2-7, 9 and 11, basic details of the modifier 10 are described, according to an exemplary embodiment. The modifier 10 includes a base 20 supporting a grinding stone 60 therein. The base 20 includes the top surface 30 with a slit 40 extending therethrough. A slot 50 is formed in an undersurface 22 of the base 20 with the slot 50 sized to receive the stone 60 therein. The slot 50 is oriented so that a grinding surface 62 of the stone 60 is located and oriented appropriately adjacent to the slit 40 so that when teeth T adjacent a distal end of the blade B extend into the slit 40, portions of the facet F come into contact with grinding surface 62. Movement of the blade B (along arrow C of FIGS. 3 and 4) causes removal of material and formation of the face E adjacent to the tip P of the blade B. The modifier 10 assists in control of the orientation of the blade B and the orientation of the grinding surface 62 of the stone 60 relative to the slit 40, so that the face E is easily and precisely formed at a desired face angle β.

More specifically, and with particular reference to FIGS. 2, 3, 5-7, 9 and 11, particular details of the modifier 10 are described, according to this exemplary embodiment. The modifier 10 is preferably formed of two separate parts formed of different materials and brought together to be motionless relative to each other. These parts include the base 20 and a grinder, preferably in the form of the grinding stone 60. This stone 60 is held in a position within the base 20 so that a grinding surface 62 of the stone 60 is presented in an appropriate angle for access by a trimmer blade B through the slit 40 and for modification of the blade B.

The base 20 is preferably a unitary mass of polymeric hydrocarbon material or other material which can be readily molded, and particularly injection molded or otherwise formed. Examples include polyethylene, poly propylene and other materials generally identified as plastics. The base 20 is flattened to have a limited height and also formed to exhibit an elongate form.

An undersurface 22 is provided opposite the top surface 30. The undersurface 22 includes a foot 26 at a perimeter thereof which is configured to be oriented within a plane so that it can rest upon a (preferably horizontal) flat surface upon which it can be securely held, to keep the base 20 (and the stone 60) stationary while the blade B oscillates linearly (along arrow C of FIGS. 3 and 4) for modification of the blade B.

The undersurface 22 is preferably concave so that it has a ceiling 24 elevated above lowermost portions of the undersurface 22. An under rib 28 preferably extends downward from the ceiling 24 and causes a vertical thickness of the base 20 to be increased slightly around central portions of the base 20 where the slit 40 is located. The under rib 28 thus adds material and strengthens the base 20 somewhat in regions thereof adjacent to the slit 40.

Preferably the base 20 has a general outline defined by perimeter skirt 38 which is rectangular with two opposing long sides and two opposing short ends, and also with a height defined as the distance between the undersurface 22 and the top surface 30. Preferably the long sides of the base 20 are at least about three times longer than a length of the end sides of the base 20, so that the base 20 has a generally elongate form. These long sides are preferably parallel to each other and spaced apart by length of the end sides. The end sides are also preferably parallel to each other and spaced apart by a length of the long sides. The height of the base 20 is preferably less than about a fourth as tall as the end sides are long. The top surface 30 and under surface 22 are opposite each other and generally planar, except for the concave portions nearest a center of the under surface 22 and as the top surface 30 is domed somewhat, with various flats.

The top surface 30 defines a portion of the base 20 which is held by a hand of a user U (FIG. 4) while the blade B is also held by a hand of the user U and the blade B is moved relative to the base 20 for sharpening of the blade B. The top surface 30 is particularly configured to include a top flat 32 which is horizontal when the base 20 is resting upon a horizontal surface through the foot 26. This top flat 32 surrounds portions of the base 20 where the slit 40 is located. Side flats 34 extend downward from the top flat 32 to portions of the perimeter skirt 38 defining the end sides of the base 20. Long flats 36 taper down from the top flat 32 to portions of the perimeter skirt 38 defining the long sides of the base 20.

Figure 4:
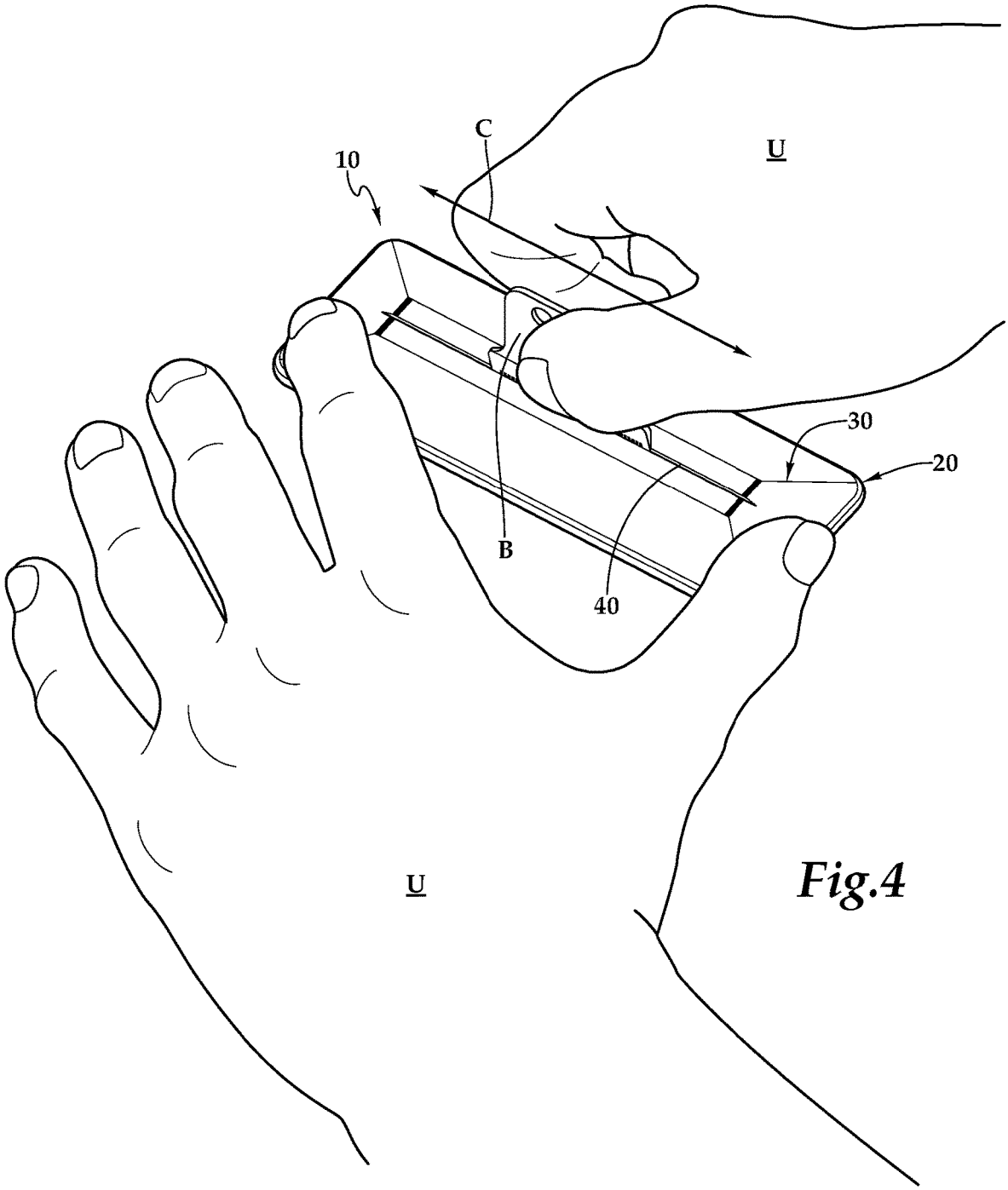
FIG. 4 is a perspective view of the tool and trimmer blade and with a user shown holding the tool and moving the trimmer blade for modification of the trimmer blade, as also depicted in FIG. 3.
Figure 5:
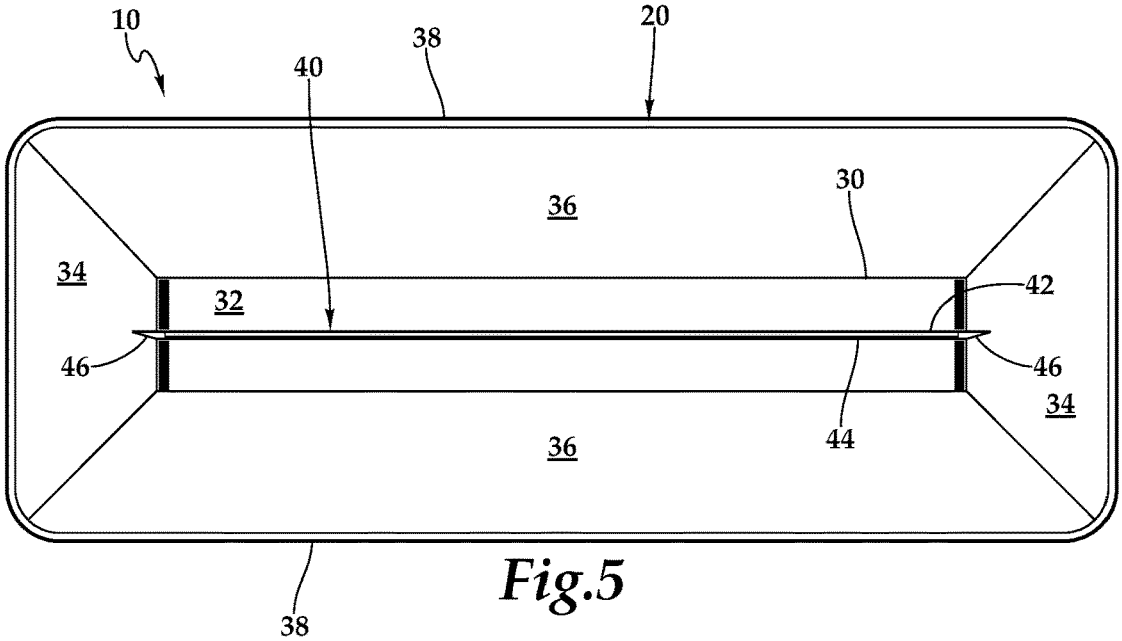
FIG. 5 is a top plan view of the trimmer blade modification tool of this invention.
Figure 6:
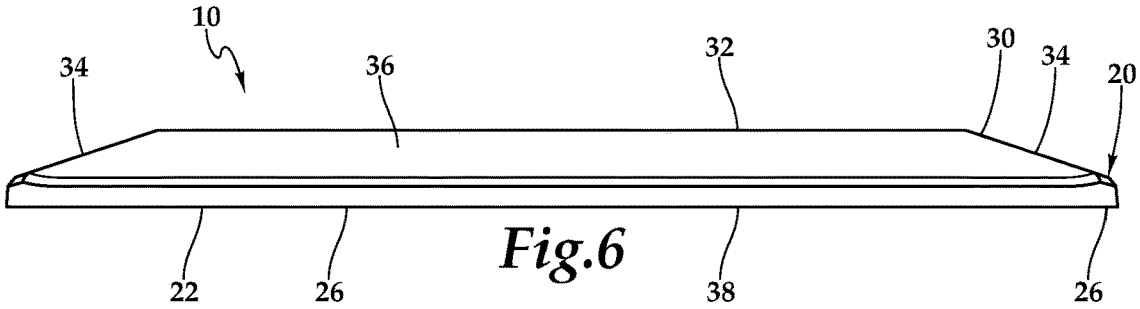
FIG. 6 is a front elevation view of that which is shown in FIG. 5.

The side flats 34 define a portion of the top surface 30 between ends 46 of the slit 40 and portions of the perimeter skirt 38 defining end sides of the top surface 30 of the base 20. These side flats 34 provide finger purchase areas where a thumb and forefinger (or other fingers) of a user U can press down on the base 20 to hold the modifier 10 in fixed position upon a horizontal (or other flat) underlying surface (FIG. 4). While these portions of the top surface 30 are shown faceted, top surface 30 could be more rounded in alternative embodiments or could include structures which match at least partial contours of fingers of a user, to further enhance the ability for the base 20 to be held stationary upon an underlying surface by a hand of a user U.

The slit 40 is formed in the top surface 30 and extends down entirely through the base 20 into communication with the slot 50 extending up into the under rib 28 in the ceiling 24 of the undersurface 22 of the base 20. This slit 40 is elongate in form but not as long as the base 20. Rather, the slit 40 has ends 46 which remain within the top flat 32 or extend just to (or slightly beyond) edges of the top flat 32. These ends 46 define a length of the slit 40.

Figure 8:
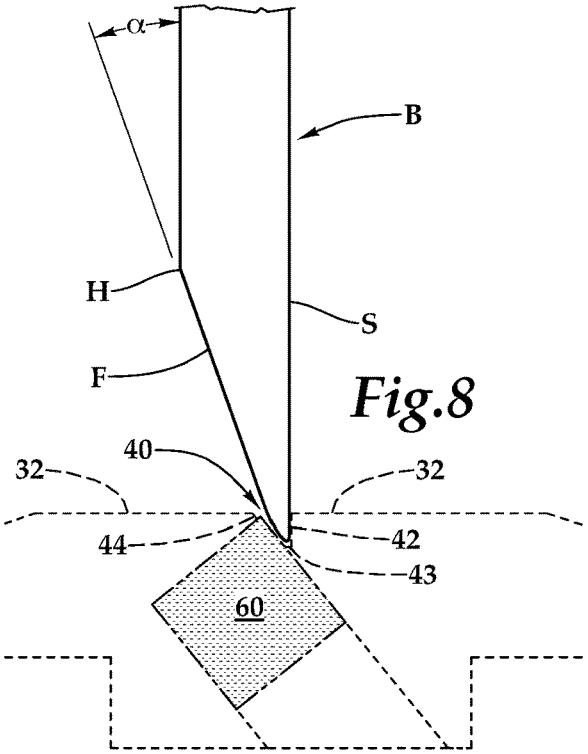
FIG. 8 is a side elevation view of a distal portion of a trimmer blade before modification with the tool of this invention and according to the method of this invention, and showing in broken lines an outline of the tool of this invention just before use to modify the blade.
Figure 10:
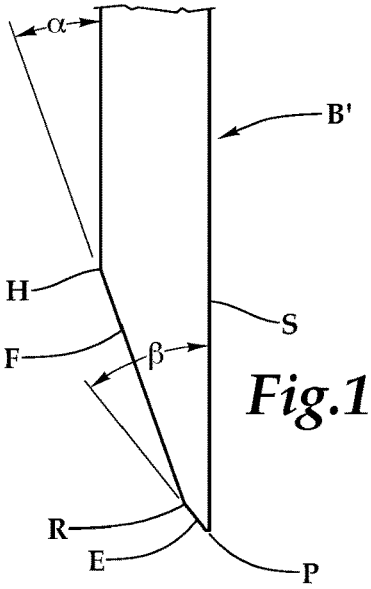
FIG. 10 is a side elevation view similar to that which is shown in FIG. 8, but after modification of the trimmer blade according to this invention.
Figure 11:
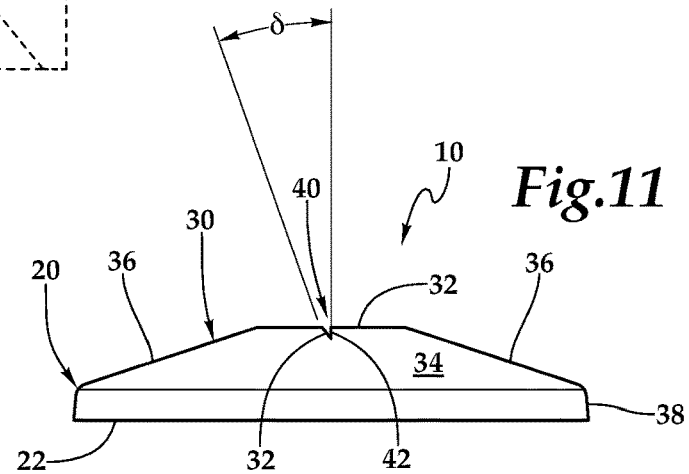
FIG. 11 is an end elevation view of that which is shown in FIG. 5.

The slit 40 has two opposing sides (FIG. 11) including a flat side 42 and angled side 44 (FIGS. 2-5 and 8) which extend between the ends 46 and which face each other. The flat side 42 is preferably oriented within a vertical plane perpendicular to the top surface 30 and under surface 22. The angled side 44 preferably angles at an angle δ, which is between an angle matching a facet angle α for the blade B to be modified and an angle of the face E after blade B' modification, and most preferably matching the face E angle β. A reference surface S of a blade B can rest against the flat side 42 while the facet F of the blade B can be near (or rest against) angled side 44 and the blade B can be held at a proper orientation (or just against the flat side 42 as an alternative). A flat stopper 43 joins the flat side 42 and angled side 44 at a lower end of the slit to keep the tip P of the blade from getting too sharp, but rather remaining slightly blunt (FIGS. 8 and 10).

Distal portions of the blade B then come into contact with the stone 60 which is located within the slot 50 below the slit 40, with the grinding surface 62 of the stone 60 appropriately angled to cause the face E to be formed and have face angle (3. In one embodiment, this face angle β is 39°. The facet angle α is less than this face angle β and matches an angle at which the blade B is originally provided. This facet angle α can differ based on the manufacture of the blade B. A range of such facet angles for existing blades can be approximately 15° to 30° in many cases.

Figure 7:
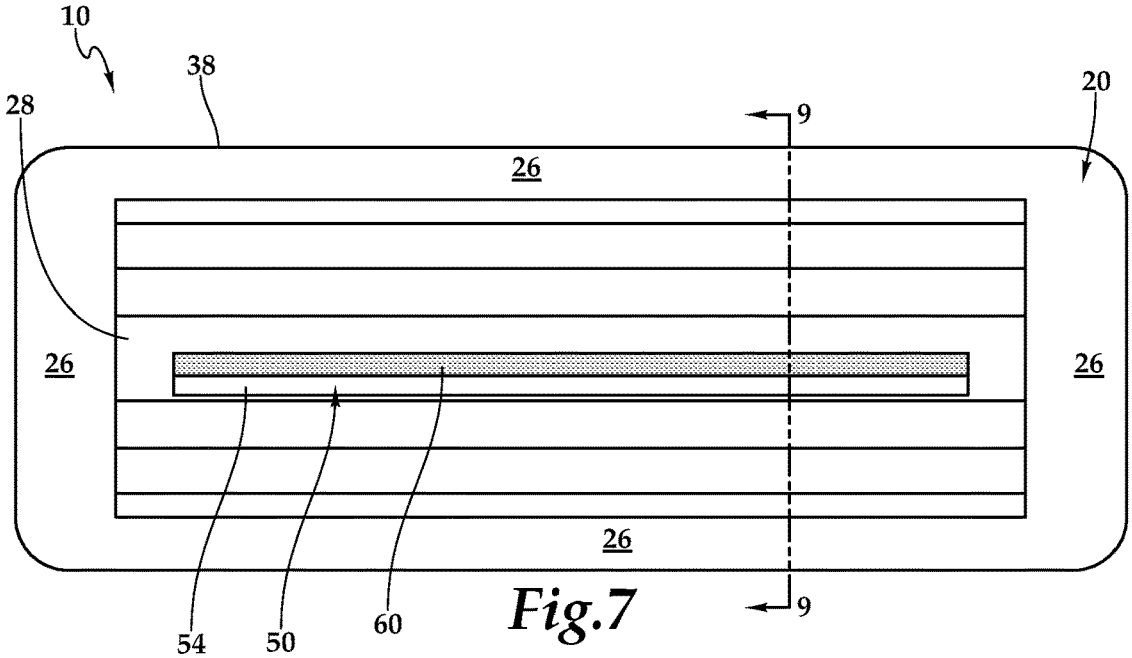
FIG. 7 is a bottom plan view of that which is shown in FIG. 5.
Figure 9:
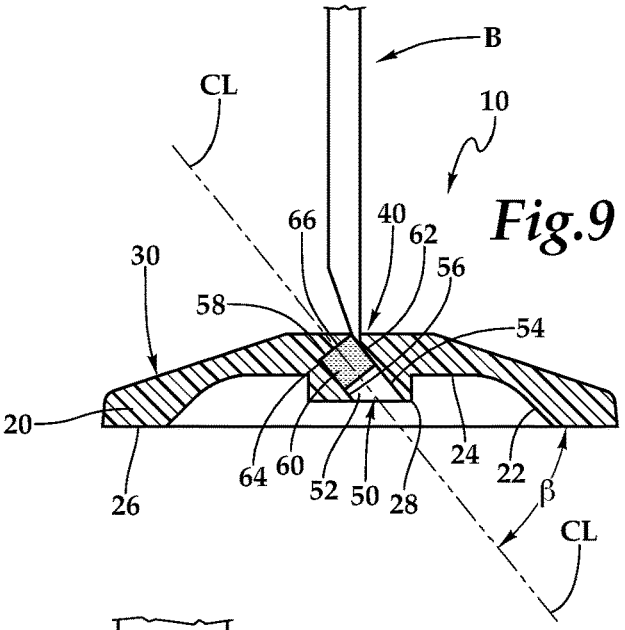
FIG. 9 is a side elevation full sectional view of that which is shown in FIG. 3, taken along lines 9-9 of FIG. 7 and showing how the distal tip of the trimmer blade fits through a slit in the top surface of the base of the modifier tool to come into contact with a stone acting as a grinder and fitted within a slot in the base, for providing the desired modification to the distal tip of the trimmer blade according to this invention.

With particular reference to FIGS. 7 and 9, details of the slot 50 are described, according to this exemplary embodiment. The slot 50 provides one form of recess into which a grinder, such as the stone 60, can be placed. In this particular embodiment, the stone 60 has a square or rectangular cross-section and is elongate in form having a length similar to a length of the slit 40 in this example or embodiment. The stone 60 thus has a grinding surface 62 parallel and spaced from an opposite surface 64. An inner surface 66 is perpendicular to the grinding surface 62 and opposite surface 64 and spaces the grinding surface 62 from the opposite surface 64. An outer surface is also provided opposite the inner surface 66 and provides that portion of the stone 60 which can be seen in FIG. 7 with the stone 60 located within the slot 50.

The slot 50 is preferably generally rectangular in form but angled to be aligned with a centerline CL which is angled away from vertical by an angle similar to the face angle β. Because the centerline CL is angled, the slot 50 includes a long side 54 on one side and a short side 56 opposite the long side 54 and extending into the under rib 28 of the ceiling 24 in the undersurface 22 of the base 20, through an opening 52. An inner side 58 of the slot 50 defines an innermost portion of the slot 50. Long side 54 and short side 56 are preferably parallel and spaced each other a distance similar to a distance between the grinding surface 62 and the opposite surface 64, so that the stone 60 fits snuggly within the slot 50 with the grinding surface 62 angled but located closest to the slit 40 above the slot 50.

The slit 40 and slot 50 connect together and with a width of the slot 40 sufficiently large so that a distal-most portion of the blade B can extend down through the slit 40 and into the slot 50 to contact the grinding surface 62 of the stone 60. The angle of the grinding surface 62, caused to match the long side 54 and centerline CL of the slot 50, has an angle matching the face angle β so that the face E is formed into the blade B' having the face angle β.

To at least some extent, a width of the slit 40 at a lower most portion thereof, where it accesses into the slot 50 defines an amount of material which can be removed on the blade B when it is modified (to the blade B') according to this invention and how sharp the tip P of the blade B' can become. The flat stopper 43 defines this width. Preferably, this width of the slit 40 is initially kept relatively small so that only a small amount of material needs to be removed to form the face E at the distal portion of the blade B. As one example, this width of the slit 40 at the flat stopper 43 can be 0.7 mm.

FIGS. 8 and 10 depict a distal tip of the blade B before (FIG. 8) and after (FIG. 10) the blade B' has been modified. FIG. 8 also shows in broken lines portions of the modifier 10 just before they are used to modify the blade B according to this invention. The blade B initially has a reference surface S which is oriented vertically as well as an opposing surface which is also oriented vertically. A heel H defines the transition of this opposing surface from parallel to the reference surface S to angled into the facet F. This angling of the facet F away from vertical at the heel H is defined by angle α. This facet F extends downwardly and tapers toward the reference surface S and to a distal portion of the blade B where the teeth T (FIG. 1) are located. An unmodified blade B will tend to have the facet F transition into a tip at a distal most portion of the blade B through a somewhat blunt and rounded finishing of the distal end of the facet F.

With this invention, and after modification of the blade B', a transition R is provided between the facet F and the face E. The face E has a greater angle, face angle β, then the angle of facet F, referenced by angle α, and with both angles measured relative to reference surface S and with the reference surface S generally considered to be vertical. A more pronounced tip P is thus provided at a lowermost portion of the face E, but still slightly blunt at this tip P, due to the flat stopper 43.

In use and operation and with particular reference to FIGS. 2-4 and 9, details of the use of modifier 10 according to a method of this invention to modify a blade B are described, according to an exemplary embodiment. Initially, the blade B has a distal portion thereof placed into the slit 40 (along arrow A of FIG. 2). The blade B will typically have one side which has a logo thereon and which also has a facet F adjacent to the teeth T. A top surface 30 of the base 20 of the modifier 10 is preferably printed with wording such as "blade brand logo on this side" which is adjacent to the angled side 44 of the slit 40 which is angled relative to vertical. Other orientation verification can alternatively be used.

Figure 3:
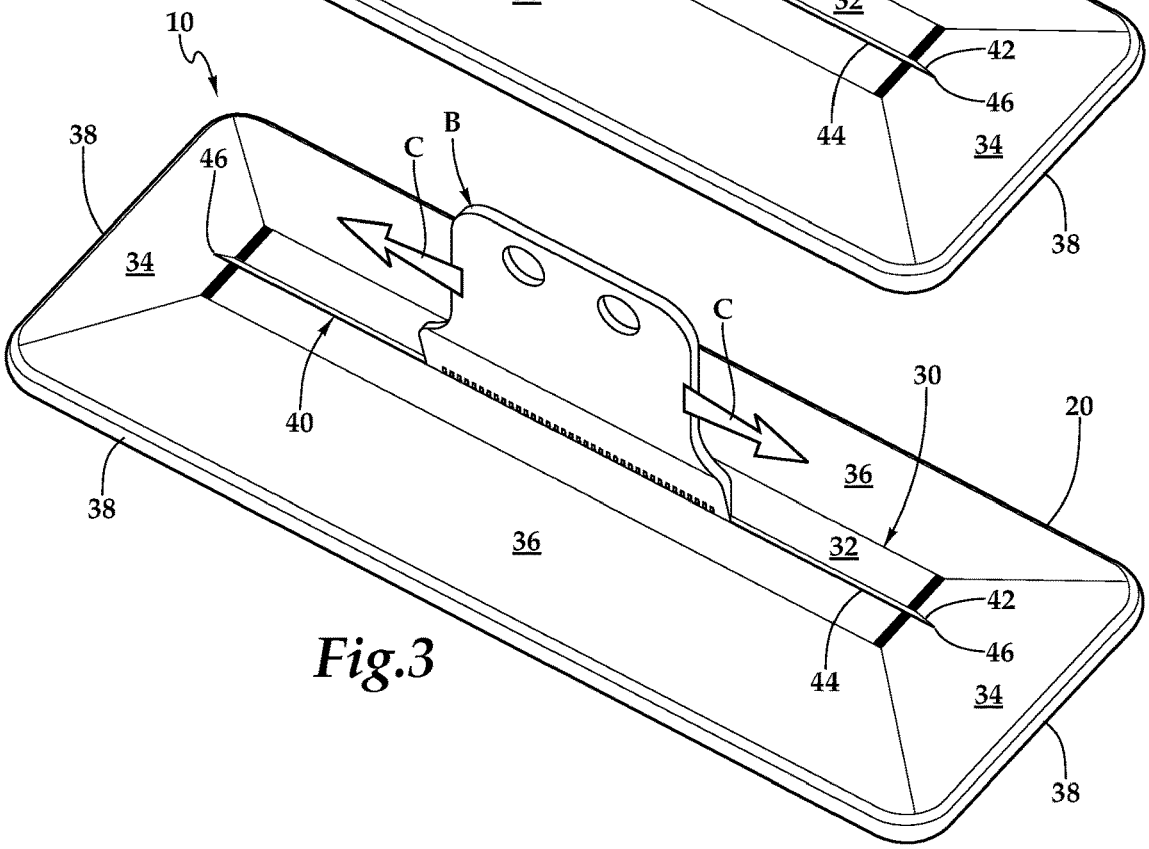
FIG. 3 is a perspective view of the tool and trimmer blade with the trimmer blade in the process of being modified by the tool.

Once the blade B has been inserted with the distal portion thereof and within the slit 40, the user U holds the base 20 of the modifier 10 firmly with one hand (FIG. 4) while grasping the blade B and oscillating blade B back-and-forth rapidly along the slit 40 (along arrow C of FIGS. 3 and 4). For a typical blade B and with a modifier 10 with an appropriately thin width at lowermost portions of the slit 40, approximately thirty seconds are involved before the tip P of the blade B' has been provided with the face E.

After thirty seconds of grinding by back-and-forth oscillation motion, a user can inspect the distal end of the blade B and can repeat if needed. Once completed, the blade B' is provided with the face E according to this invention. The blade B can then be reattached to the trimmer machine from which it was removed before sharpening, and is ready for use.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. An apparatus for modifying a trimmer blade, the apparatus comprising in combination:

a base;

a grinder held by said base;

said base including an underside opposite a top surface, said grinder accessible by the trimmer blade through said top surface; said underside having lowermost portions in a common plane to allow said underside to rest firmly upon a flat surface; and wherein said base is elongate in form with a slit in said top surface, said slit elongate in form and oriented with ends of said slit adjacent to ends of said base defining a longest dimension of said base, said base longer than said slit between said ends of said base with finger purchase areas between each of said ends of said slit and said ends of said base.

2. The apparatus of claim 1 wherein a guide in said base is configured to at least partially orient a trimmer blade at a desired angle when the trimmer blade is located adjacent to said grinder.

3. The apparatus of claim 2 wherein said guide includes an elongate slit extending through a top surface of said base down to said grinder beneath said top surface.

4. The apparatus of claim 3 wherein said grinder includes a grinding surface of a grinding stone located beneath said elongate slit, said elongate slit having a flat side opposite an angled side, said flat side oriented within a substantially vertical plane, said angled side angled relative to said flat side so that said slit tapers from a greater width to a lesser width as said elongate slit extends downwardly through said top surface toward said grinding stone.

5. The apparatus of claim 4 wherein said angled side of said slit matches an angle of a plane in which said grinding surface of said grinding stone is oriented.

6. The apparatus of claim 1 wherein said top surface includes a top flat adjacent to said slit and with side flats at ends of said base extending between said top flat and portions of said ends of said base defining part of a perimeter of said base.

7. The apparatus of claim 1 wherein said grinder includes a grinding stone.

8. The apparatus of claim 7 wherein a slot is formed in said base, said slot sized to receive said grinding stone therein and to hold said grinding stone in an orientation to cause a surface of said grinding stone to grind away at portions of the trimmer blade when the trimmer blade is brought adjacent to said grinding stone and moved relative to said grinding stone.

9. The apparatus of claim 8 wherein said grinding stone has a grinding surface, said slot having a long side and a short side parallel and opposite each other, spaced apart by a distance similar to a depth of said grinding stone between said grinding surface and an opposite surface of said grinding stone located opposite said grinding surface, said opposite surface of said grinding stone located adjacent to said short side of said slot.

10. The apparatus of claim 9 wherein said base includes a top surface opposite an under surface, said slot extending up into said under surface and with an elongate slit extending through said top surface sufficiently far to access said grinding stone within said slot through said slit, said slot angled relative to said top surface of said base to cause said grinding surface of said grinding stone to be oriented to cause a face to be ground into the trimmer blade at an angle matching said angle of said grinding surface of said grinding stone.

11. An apparatus for modifying a trimmer blade, the apparatus comprising in combination:

a base;

a grinder held by said base;

said base including an underside opposite a top surface, said grinder accessible by the trimmer blade through said top surface;

said underside having lowermost portions in a common plane to allow said underside to rest firmly upon a flat surface;

wherein said grinder includes a grinding stone;

wherein a slot is formed in said base, said slot sized to receive said grinding stone therein and to hold said grinding stone in an orientation to cause a surface of said grinding stone to grind away at portions of the trimmer blade when the trimmer blade is brought adjacent to said grinding stone and moved relative to said grinding stone;

wherein said grinding stone has a grinding surface, said slot having a long side and a short side parallel and opposite each other, spaced apart by a distance similar to a depth of said grinding stone between said grinding surface and an opposite surface of said grinding stone located opposite said grinding surface, said opposite surface of said grinding stone located adjacent to said short side of said slot;

wherein said base includes a top surface opposite an under surface, said slot extending up into said under surface and with an elongate slit extending through said top surface sufficiently far to access said grinding stone within said slot through said slit, said slot angled relative to said top surface of said base to cause said grinding surface of said grinding stone to be oriented to cause a face to be ground into the trimmer blade at an angle matching said angle of said grinding surface of said grinding stone; and wherein said slot has a centerline angled at a face angle which is greater than a facet angle for the trimmer blade to be sharpened.

12. A method for modifying a trimmer blade, including the steps of:

placing teeth of a trimmer blade adjacent to a grinder within a trimmer blade modifying apparatus including a base, a grinder held by the base, the base including an underside opposite a top surface, the grinder accessible by the trimmer blade through the top surface, and the underside having lowermost portions in a common plane to allow the underside to rest firmly upon a flat surface;

moving the trimmer blade lateral to the grinder to grind material from the teeth of the trimmer blade; and orienting the trimmer blade relative to the grinder to add a planar face adjacent to a tip of the trimmer blade at an angle which is greater than a facet angle of teeth of the trimmer blade.

13. The method of claim 12 wherein said orienting step includes the base having a slit extending through a top surface thereof down to the grinder, the slit having sides oriented at different angles to cause the teeth of the trimmer blade to be oriented relative to a grinding surface of the grinder appropriate to cause the formation of the face adjacent to the tip of the trimmer blade.

14. The method of claim 13 wherein the slit includes a flat side opposite an angled side, the flat side oriented within a substantially vertical plane perpendicular to the underside of the base of the trimmer blade modifying apparatus, the angled side oriented at an angle causing said slot to be wider at upper portions thereof then at lower portions thereof.

15. The method of claim 14 wherein the angled side of the slit is oriented at an angle matching an angle of a plane in which the grinding surface of the grinding stone is oriented.

16. The method of claim 15 wherein said placing step includes placing the trimmer blade within a vertical plane and the underside of the base of the modifying apparatus against an underlying surface that is in a horizontal plane, and with the teeth of the trimmer blade adjacent to the grinding surface of the grinding stone.

17. A modified trimmer blade, modified by a process including the steps of:

placing teeth of a trimmer blade adjacent to a grinder within a trimmer blade modifying apparatus including a base, a grinder held by the base, the base including an underside opposite a top surface, the grinder accessible by the trimmer blade through the top surface, and the underside having lowermost portions in a common plane to allow the underside to rest firmly upon a flat surface;

moving the trimmer blade lateral to the grinder to grind material from the teeth of the trimmer blade; and the modified trimmer blade further including a facet opposite a planer reference surface and angled relative to said reference surface by a facet angle, and with a face opposite said reference surface and closer to a tip of said trimmer blade than said facet, said face angled relative to said reference surface by a face angle, said face angle greater than said facet angle.

* * * * *